US010056183B2

(12) United States Patent
Yoon et al.

(10) Patent No.: US 10,056,183 B2
(45) Date of Patent: Aug. 21, 2018

(54) COIL COMPONENT AND BOARD HAVING THE SAME

(71) Applicant: SAMSUNG ELECTRO-MECHANICS CO., LTD., Suwon-Si, Gyeonggi-Do (KR)

(72) Inventors: Chan Yoon, Suwon-Si (KR); Dong Hwan Lee, Suwon-Si (KR); Young Ghyu Ahn, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 704 days.

(21) Appl. No.: 14/621,282

(22) Filed: Feb. 12, 2015

(65) Prior Publication Data

US 2016/0078994 A1 Mar. 17, 2016

(30) Foreign Application Priority Data

Sep. 16, 2014 (KR) ..... 10-2014-0122873

(51) Int. Cl.

| | |
|---|---|
| ***H01F 5/00*** | (2006.01) |
| ***H01F 27/29*** | (2006.01) |
| ***H01F 27/02*** | (2006.01) |
| ***H01F 17/00*** | (2006.01) |
| *H01F 1/34* | (2006.01) |

(52) U.S. Cl.

CPC ..... *H01F 27/292* (2013.01); *H01F 5/00* (2013.01); *H01F 17/0013* (2013.01); *H01F 27/02* (2013.01); *H01F 1/34* (2013.01); *H01F 2017/0066* (2013.01)

(58) Field of Classification Search

CPC ..... H01F 27/00–27/36; H01F 5/00
USPC ..... 336/65, 83, 200, 212, 232–234
See application file for complete search history.

(56) References Cited

U.S. PATENT DOCUMENTS

| | | | | |
|---|---|---|---|---|
| 4,253,079 A * | 2/1981 | Brosh | G01D 5/2046 | 336/136 |
| 6,515,556 B1 | 2/2003 | Kato et al. | | |
| 7,262,680 B2 * | 8/2007 | Wang | H01F 17/0013 | 257/531 |

(Continued)

FOREIGN PATENT DOCUMENTS

| | | |
|---|---|---|
| CN | 1434468 A | 8/2003 |
| CN | 1822255 A | 8/2006 |

(Continued)

OTHER PUBLICATIONS

Chinese Office Action dated Jul. 4, 2017 issued in Chinese Patent Application No. 201510092948.9 (with English translation).

*Primary Examiner* — Tuyen Nguyen
(74) *Attorney, Agent, or Firm* — McDermott Will & Emery LLP

(57) ABSTRACT

There are provided a coil component and a board having the same. The coil component may include: a magnetic body including a substrate having two cores, first and second coil parts disposed on one surface of the substrate, and third and fourth coil parts disposed on the other surface of the substrate; a connection part disposed to penetrate through the two cores in the magnetic body and connecting the two cores to each other; and first to fourth external electrodes disposed on outer surfaces of the magnetic body and connected to the first to fourth coil parts.

16 Claims, 4 Drawing Sheets

(56) References Cited

U.S. PATENT DOCUMENTS

| | | | | |
|---|---|---|---|---|
| 7,312,682 | B2 * | 12/2007 | Yasuda | H01F 17/045 336/200 |
| 2003/0085777 | A1 | 5/2003 | Kim et al. | |
| 2003/0134612 | A1 * | 7/2003 | Nakayama | H01F 17/0013 455/307 |
| 2003/0137384 | A1 | 7/2003 | Itou et al. | |
| 2004/0130415 | A1 | 7/2004 | Chiba et al. | |
| 2012/0298407 | A1 | 11/2012 | Ahn et al. | |
| 2013/0300529 | A1 | 11/2013 | Chang et al. | |

FOREIGN PATENT DOCUMENTS

| | | | |
|---|---|---|---|
| CN | 101154494 | A | 4/2008 |
| CN | 103377811 | A | 10/2013 |
| JP | 2009-135320 | A | 6/2009 |
| KR | 2003-0037747 | A | 5/2003 |
| KR | 10-2005-0011090 | A | 1/2005 |

* cited by examiner

COIL COMPONENT AND BOARD HAVING THE SAME

CROSS-REFERENCE TO RELATED APPLICATION

This application claims the priority and benefit of Korean Patent Application No. 10-2014-0122873 filed on Sep. 16, 2014, with the Korean Intellectual Property Office, the disclosure of which is incorporated herein by reference.

BACKGROUND

The present disclosure relates to a coil component and a board having the same.

Electronic products such as digital televisions, smartphones, and notebook computers, have commonly transmitted and received data in a high frequency (HF) band, and henceforth, it is expected that such information technology (IT) electronic products will be more frequently used in practical applications, since such devices are able to function independently and are also able to be connected to each other via universal serial bus (USB) or other communications ports to have multiple functions and high degrees of integration.

As smartphones have been developed, demand for highly efficient and highly functional small and thin power inductors able to operate at high levels of current has increased.

Therefore, currently, a 2016-sized product having a thickness of 1 mm has been used, instead of a 2520-sized product having a thickness of 1 mm commonly used in the past. Further, it is expected that products will be further miniaturized to have 1608-size with a thickness of 0.8 mm.

Simultaneously, demand for an array having a reduced mounting area has also increased.

The array may have a coupled or non-coupled inductor form or a combination thereof, according to a coupling coefficient or mutual inductance between a plurality of coil parts.

Meanwhile, in a case in which a coupled inductor is able to decrease inductor current ripples while having the same output current ripples as those of a non-coupled inductor, the efficiency of an inductor array chip may be improved without increasing the size of a mounting area thereof.

In various applications, coupled inductors having a coupling coefficient of about 1.0 to 0.9 while having a certain degree of leakage inductance have been required, rather than non-coupled inductors.

Therefore, there is a need to manufacture an inductor array product capable of decreasing inductor current ripples by increasing a mutual inductance value while having a certain degree of leakage inductance that is not excessively low to decrease output current ripples.

Related Art Document (Patent Document 1) Korean Patent Laid-Open Publication No. 2005-0011090

SUMMARY

An aspect of the present disclosure may provide a coil component and a board having the same.

According to an aspect of the present disclosure, a coil component may include: a magnetic body including a substrate having two cores, first and second coil parts disposed on one surface of the substrate, and third and fourth coil parts disposed on the other surface of the substrate; a connection part disposed to penetrate through the two cores in the magnetic body and connecting the two cores to each other; and first to fourth external electrodes disposed on outer surfaces of the magnetic body and connected to the first to fourth coil parts.

According to another aspect of the present disclosure, a board having a coil component may include: a printed circuit board on which a plurality of electrode pads are provided; and the coil component mounted on the printed circuit board, wherein the coil component includes: a magnetic body including a substrate having two cores, first and second coil parts disposed on one surface of the substrate, and third and fourth coil parts disposed on the other surface of the substrate; a connection part disposed to penetrate through the two cores in the magnetic body and connecting the two cores to each other; and first to fourth external electrodes disposed on outer surfaces of the magnetic body and connected to the first to fourth coil parts.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
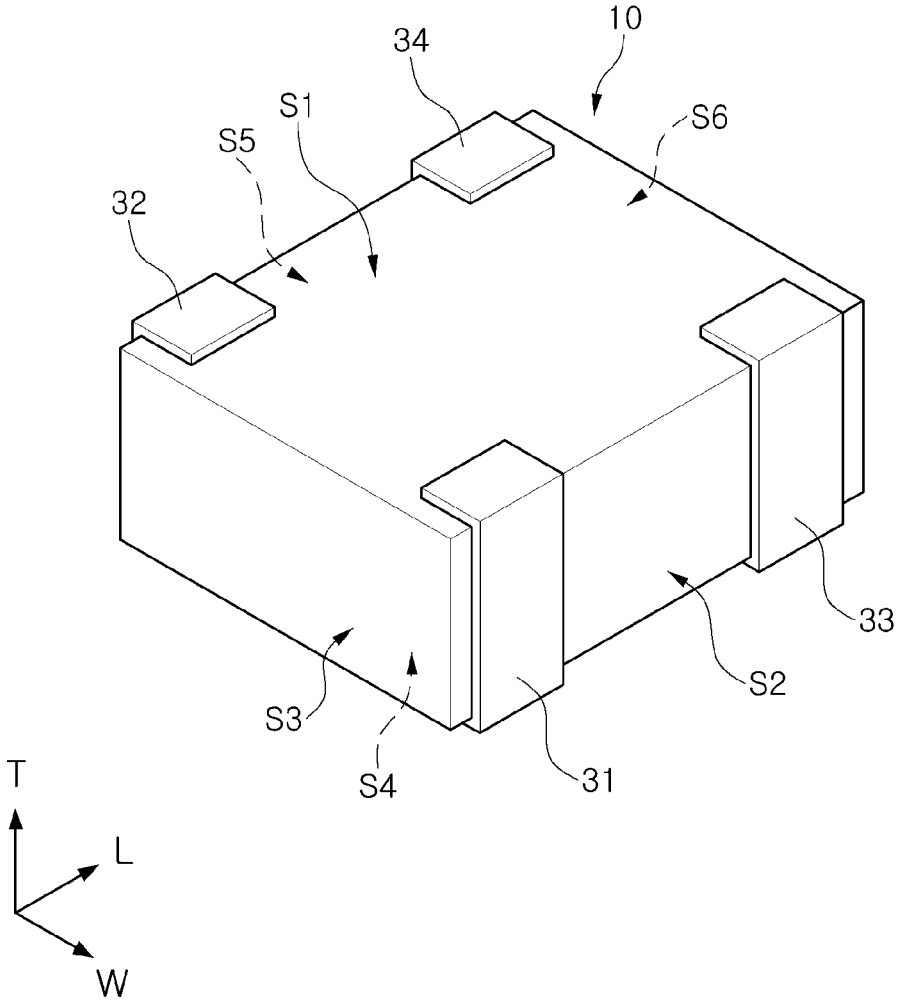
FIG. 1 is a perspective view of a coil component according to an exemplary embodiment in the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Component

FIG. 1 is a perspective view of a coil component according to an exemplary embodiment in the present disclosure.

Figure 2:
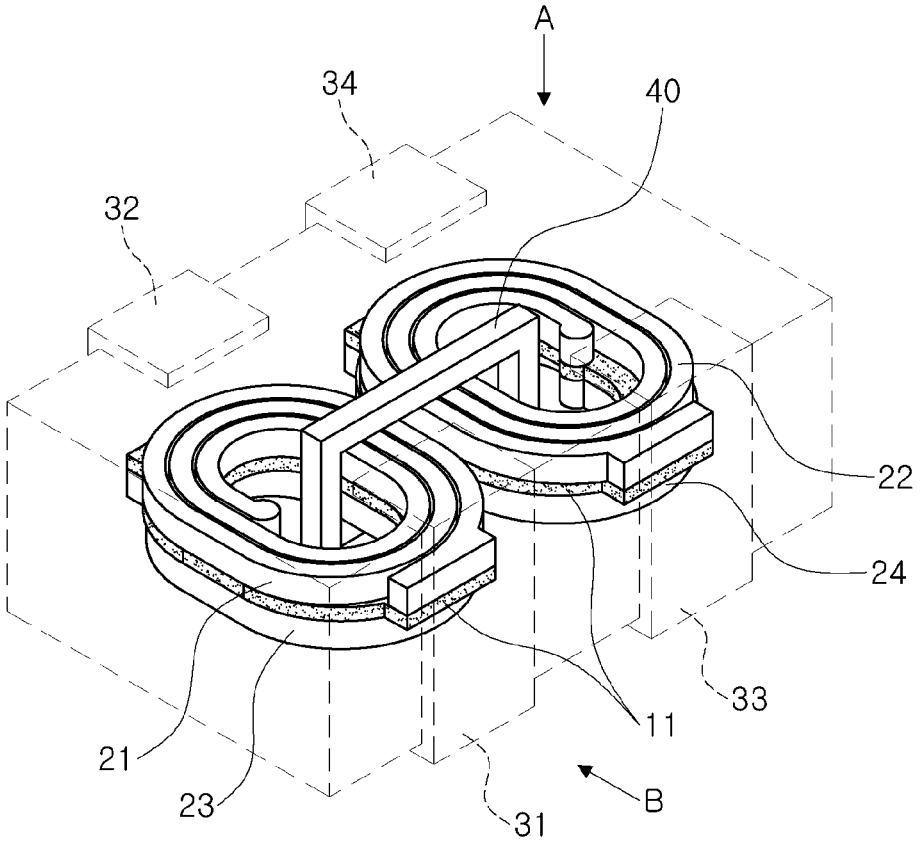
FIG. 2 is a transparent perspective view of external electrodes and a magnetic body of the coil component according to an exemplary embodiment in the present disclosure.

FIG. 2 is a transparent perspective view of external electrodes and a magnetic body of the coil component according to the exemplary embodiment in the present disclosure.

Referring to FIGS. 1 and 2, the coil component according to this exemplary embodiment may include: a magnetic body 10 including of a substrate 11 having two cores, first and second coil parts 21 and 22 disposed on one surface of the substrate 11, and third and fourth coil parts 23 and 24 disposed on the other surface of the substrate 11; a connection part 40 disposed to penetrate through the two cores within the magnetic body 10 and connecting the two cores to each other; and first to fourth external electrodes 31 to 34 disposed on outer surfaces of the magnetic body 10 and connected to the first to fourth coil parts 21 to 24.

Here, the terms "first" to "fourth" are used in order to distinguish corresponding elements from one another, regardless of the order of the corresponding elements.

The magnetic body 10 may be a hexahedron, and with regard to the directions of the magnetic body 10, an "L direction" may refer to a "length direction", a "W direction" may refer to a "width direction" and a "T direction" may refer to a "thickness direction".

The magnetic body 10 may have upper and lower surfaces S1 and S4 opposing each other, first and second end surfaces S3 and S6 connecting the upper and lower surfaces S1 and S4 to each other in the length direction, and first and second side surfaces S2 and S5 in the width direction.

The magnetic body 10 may include the substrate 11 having two cores and the first to fourth coil parts 21 to 24 disposed on the upper and lower surfaces of the substrate 11 and enclosed by an insulation film.

The magnetic body 10 may form the exterior of an inductor array chip and may be formed of any material capable of exhibiting magnetic properties. For example, the magnetic body 10 may be filled with a ferrite material or a metal-based soft magnetic material.

As the ferrite material, Mn—Zn based ferrite, Ni—Zn based ferrite, Ni—Zn—Cu based ferrite, Mn—Mg based ferrite, Ba based ferrite, Li based ferrite, or the like, may be used.

The metal-based soft magnetic material may be an alloy containing at least one selected from the group consisting of Fe, Si, Cr, Al, and Ni. For example, the metal-based soft magnetic material may contain Fe—Si—B—Cr-based amorphous metal particles, but is not limited thereto.

The metal-based soft magnetic material may have a particle diameter of 0.1 μm to 30 μm and may be dispersed in a polymer such as an epoxy resin, polyimide, or the like.

The substrate 11 may be a magnetic substrate, and the magnetic substrate may contain nickel-zinc-copper ferrite, but is not limited thereto.

In addition, the coil component according to the exemplary embodiment may include the first and third external electrodes 31 and 33 formed on one surface of the magnetic body 10 and the second and fourth external electrodes 32 and 34 formed on the other surface of the magnetic body 10 opposing one surface of the magnetic body 10.

Hereinafter, the first to fourth coil parts 21 to 24, the first to fourth external electrodes 31 to 34, and the connection part 40 will be detailed.

Figure 3:
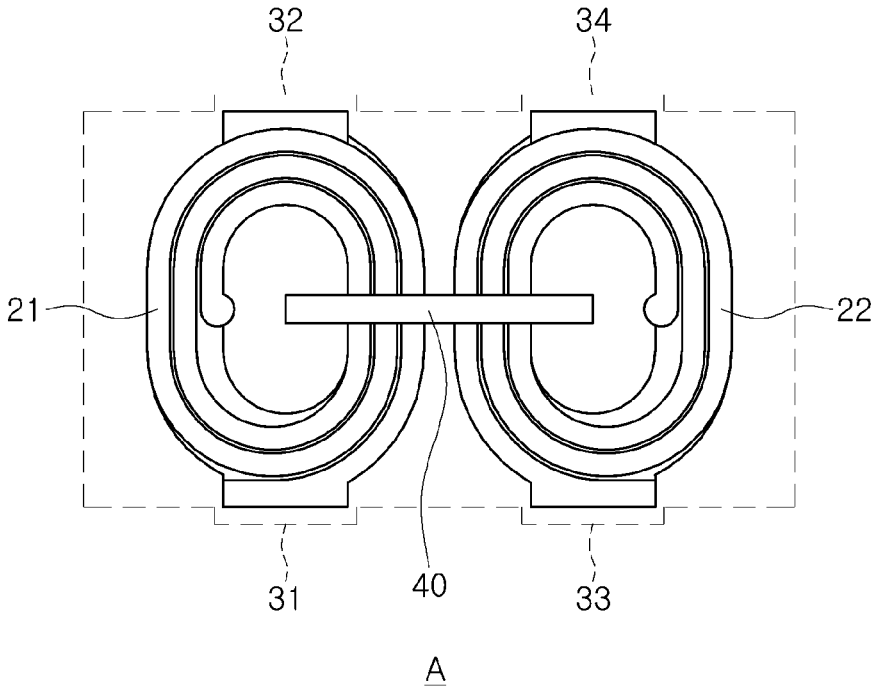
FIG. 3 is a transparent plan view illustrating the interior of the coil component in A direction of FIG. 2.

FIG. 3 is a transparent plan view of the coil component in A direction of FIG. 2.

Figure 4:
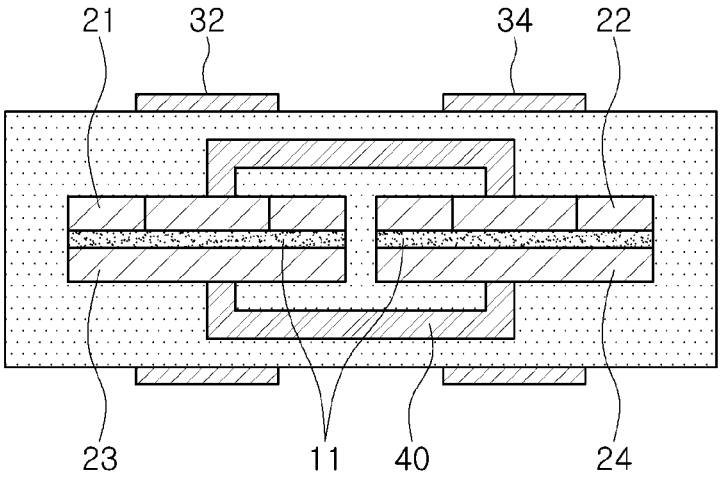
FIG. 4 is a transparent side view illustrating the interior of the coil component in B direction of FIG. 2.

FIG. 4 is a transparent side view of the coil component in B direction of FIG. 2.

Referring to FIGS. 3 and 4, the first and second coil parts 21 and 22 may be disposed in parallel to each other on one surface of the substrate 11 to be spaced apart from each other and may be wound on the same plane to be spaced apart from each other in the length direction of the magnetic body 10.

Further, the third and fourth coil parts 23 and 24 may be disposed in parallel to each other on the other surface of the substrate 11 to be spaced apart from each other and may be wound on the same plane to be spaced apart from each other in the length direction of the magnetic body 10.

Therefore, a basic structure of the coil component according to the exemplary embodiment may be a non-coupled inductor array form, and the coil component includes the connection part 40 disposed to penetrate through the two cores in the magnetic body 10 and connecting the two cores to each other as described below, such that the coil component may have characteristics of a coupled inductor array form.

The first and second coil parts 21 and 22 may be disposed to be symmetrical to each other on the basis of a central portion of the magnetic body 10 in the length direction of the magnetic body 10.

In addition, the third and fourth coil parts 23 and 24 may be disposed to be symmetrical to each other on the basis of the central portion of the magnetic body 10 in the length direction of the magnetic body 10.

The first and second coil parts 21 and 22 may be symmetrically mirrored on the basis of the central portion of the magnetic body 10, and the third and fourth coil parts 23 and 24 may also be symmetrically mirrored on the basis of the central portion of the magnetic body 10.

The central portion of the magnetic body 10 may refer to a central region of the magnetic body 10 in the length direction thereof, but does not refer to a point which is accurately positioned to have the same distance from both end portions of the magnetic body 10 in the length direction.

The center of each of the first and second coil parts 21 and 22 which are wound on one surface of the substrate may be referred to as a core, and hereinafter, will be used as the same concept.

Further, the center of the third coil part 23 which is wound on the other surface of the substrate 11 and the center of the fourth coil part 24 which is wound on the other surface of the substrate 11 may be referred to as cores, respectively, such that the substrate 11 may have two cores.

According to an exemplary embodiment, the first and second coil parts 21 and 22 may be symmetrical to each other on the basis of the center of the magnetic body such that the first and second coil parts 21 and 22 have the same inductance value, and the third and fourth coil parts 23 and 24 may be symmetrical to each other on the basis of the center of the magnetic body such that the third and fourth coil parts 23 and 24 have the same inductance value.

In addition, one ends of the first and second coil parts 21 and 22 may be exposed to the first side surface S2 of the magnetic body 10 in the width direction thereof, and one ends of the third and fourth coil parts 23 and 24 may be exposed to the second side surface S5 of the magnetic body 10 in the width direction thereof, such that one ends of the first and second coil parts 21 and 22 and one ends of the third and fourth coil parts 23 and 24 may be connected to the first to fourth external electrodes 31 to 34, respectively.

That is, in a case in which one end of the first coil part 21 is exposed to the first side surface S2 of the magnetic body 10 in the width direction thereof, one end of the second coil part 22 wound in parallel to the first coil part 21 on the same plane in the same direction may be exposed to the first side surface S2 of the magnetic body 10.

The exposed end of the first coil part 21 may be connected to the first external electrode 31, and the exposed end of the second coil part 22 may be connected to the third external electrode 33.

Further, the first and second coil parts 21 and 22 may be symmetrical to each other on the basis of the center of the magnetic body 10.

Due to the above-mentioned feature, the first and second coil parts 21 and 22 may have the same length.

Similarly, one end of the third coil part 23 disposed on the lower surface of the substrate 11 may be exposed to the second side surface S5 of the magnetic body 10 in the width direction thereof.

In addition, one end of the fourth coil part 24 disposed on the same plane to be spaced apart from the third coil part 23 may be exposed to the second side surface S5 of the magnetic body 10 in the width direction thereof.

The exposed end of the third coil part 23 may be connected to the second external electrode 32, and the exposed end of the fourth coil part 24 may be connected to the fourth external electrode 34.

In addition, the third and fourth coil parts 23 and 24 may have the same length.

As described above, the first to fourth coil parts 21 to 24 may be exposed to one surface and the other surface of the magnetic body 10 in the width direction thereof while being spaced apart from each other, such that the first to fourth coil parts 21 to 24 may be connected to the first to fourth external electrodes 31 to 34, respectively.

The first and third external electrodes 31 and 33 may be input terminals, and the second and fourth external electrodes 32 and 34 may be output terminals, but the present inventive concept is not limited thereto.

Meanwhile, the first and second coil parts 21 and 22 may be formed on the same plane, which is the upper surface of the magnetic substrate 11, and the third and fourth coil parts 23 and 24 may be formed on the same plane, which is the lower surface of the magnetic substrate 11. In addition, the first and third coil parts 21 and 23 may be connected to each other through a via electrode (not shown).

Similarly, the second and fourth coil parts 22 and 24 may be connected to each other through a via electrode (not shown).

Therefore, a current input through the first external electrode 31, the input terminal, may pass through the first coil part 21, the via electrode, and the third coil part 23 to flow toward the second external electrode 32, the output terminal.

Similarly, a current input through the third external electrode 33, the input terminal, may pass through the second coil part 22, the via electrode, and the fourth coil part 24 to flow toward the fourth external electrode 34, the output terminal.

The coil component according to the exemplary embodiment includes the connection part 40 disposed to penetrate through the two cores within the magnetic body 10 and connecting the two cores to each other, thereby increasing coupling coefficient.

That is, the first and second coil parts 21 and 22 are basically disposed to be spaced apart from each other, such that the first and second coil parts 21 and 22 are not mutually affected by magnetic fluxes generated thereby. However, the magnetic flux generated in each of the coil parts moves through the connection part 40 penetrating through the two cores and connecting the two cores to each other, such that the first and second coil parts 21 and 22 may be mutually affected by the magnetic fluxes. Therefore, the coil component may have a significantly large coupling coefficient value.

In other words, the basic structure of the coil component is a non-coupled inductor form, but the coil component includes the connection part 40 disposed to penetrate through the two cores in the magnetic body 10 and connecting the two cores to each other, thereby having characteristics of a coupled inductor. Therefore, the coil component may have a significantly large coupling coefficient value.

Further, the first and second coil parts 21 and 22 positioned on one surface of the substrate 11 and the third and fourth coil parts 23 and 24 positioned on the other surface of the substrate 11 may be disposed in parallel to each other while being spaced apart from each other, whereby leakage inductance may be increased.

That is, the first and second coil parts 21 and 22 and the third and fourth coil parts 23 and 24 may be disposed in parallel to each other on one surface and the other surface of the substrate 11, respectively, while being spaced apart from each other and may be wound on the same plane, while being spaced apart from each other in the length direction of the magnetic body 10, and this non-coupled inductor form may have increased leakage inductance.

Therefore, output current ripples and inductor current ripples may be simultaneously decreased, whereby efficiency of the inductor array chip may be improved without increasing a mounting area thereof.

A material of the connection part 40 is not particularly limited, but for example, a material having high permeability may be preferably used.

More specifically, the connection part 40 may contain at least one of Mn—Zn based ferrite, Ni—Zn based ferrite, Ni—Zn—Cu based ferrite, Mn—Mg based ferrite, Ba based ferrite, and Li based ferrite, but is not limited thereto.

The connection part 40 may be disposed to penetrate through the two cores and connect the two cores to each other, while the connection part 40 may be disposed to be spaced apart from the first to fourth coil parts 21 to 24 by a predetermined distance.

Therefore, the connection part 40 may change directions of the magnetic fluxes generated by the coil parts without causing electrical interferences with the first to fourth coil parts 21 to 24, thereby affecting adjacent coil parts.

That is, the first and second coil parts 21 and 22 and the third and fourth coil parts 23 and 24 are disposed in parallel to each other to be spaced apart from each other, such that leakage inductance may be increased, and the coil component includes the connection part 40, such that the coil component may have the characteristics of a coupled inductor form, thereby having a significantly large coupling coefficient value.

Meanwhile, the shape of the connection part 40 is not particularly limited, and the connection part may have, for example, a polygonal or circular cross-sectional shape in the length direction of the magnetic body 10.

The first to fourth coil parts 21 to 24 may contain at least one selected from the group consisting of gold, silver, platinum, copper, nickel, palladium, and alloys thereof.

The first to fourth coil parts 21 to 24 may be formed of any material as long as the material may impart conductivity to the coil parts, and the material of the coil parts is not limited to the above-mentioned metals.

Further, the first to fourth coil parts 21 to 24 may have a polygonal, circular, oval, or irregular shape, and the shape thereof is not particularly limited.

The first to fourth coil parts 21 to 24 may be connected to the first to fourth external electrodes 31 to 34 through lead terminals (not shown), respectively.

The external electrode may include the first to fourth external electrodes 31 to 34.

The first to fourth external electrodes 31 to 34 may be extended in the thickness direction ("T direction") of the magnetic body 10.

The first to fourth external electrodes 31 to 34 may be disposed to be spaced apart from each other to thereby be electrically isolated from each other.

The first to fourth external electrodes 31 to 34 may be extended to portions of the upper and lower surfaces of the magnetic body 10.

Since portions of the first to fourth external electrodes 31 to 34 bonded to the magnetic body 10 have an angled shape, adhesive force between the first to fourth external electrodes 31 to 34 and the magnetic body 10 may be improved, whereby impact resistance and the like may be improved.

A metal forming the first to fourth external electrodes 31 to 34 is not particularly limited as long as the metal may impart electrical conductivity to the first to fourth external electrodes 31 to 34.

More specifically, the first to fourth external electrodes 31 to 34 may contain at least one selected from the group consisting of gold, silver, platinum, copper, nickel, palladium, and alloys thereof.

Gold, silver, platinum, and palladium are expensive but are stable, while copper and nickel are inexpensive but may be oxidized during a sintering process to thereby decrease electrical conductivity.

A thickness of the magnetic body 10 may be 1.2 mm or less, but is not limited thereto. The thickness of the magnetic body 10 may be varied.

The following table 1 shows inductance and coupling coefficient values of a coil component according to an inventive example and a non-coupled inductor according to a comparative example.

TABLE 1

| | Comparative Example | Inventive Example |
|---|---|---|
| Self Inductance [μH] (First Coil Part/Second Coil Part) | 0.48603/0.48603 | 1.1159/1.1159 |
| Coupling Coefficient | 0.10986 | 0.4653 |
| Mutual Inductance [μH] | 0.05339 | 0.51923 |

Referring to table 1, it can be seen that a general non-coupled inductor according to the comparative example had a significantly small coupling coefficient value of about 0.1, and thus, mutual inductance was also significantly low.

On the contrary, the coil component according to the inventive example having a structure in which cores having two coils wound to be spaced apart from each other in a magnetic body were connected by a connection part formed of a material having high permeability, had a large coupling coefficient value of about 0.5.

Therefore, mutual inductance was also significantly increased to about 0.51923, as compared to the comparative example.

Further, two coils positioned on each of both surfaces of the substrate were disposed in parallel to each other while being spaced apart from each other, leakage inductance was increased.

That is, it can be seen that the self inductance value in the comparative example was 0.48603, but the self inductance value in the inventive example was 1.1159.

Therefore, according to an exemplary embodiment of the present disclosure, output current ripples and inductor current ripples may be simultaneously decreased, whereby the efficiency of the inductor array chip may be improved without increasing a mounting area thereof.

In table 1, as the coupling coefficient is closer to 1, the coupling coefficient is increased.

Board Having Coil Component

Figure 5:
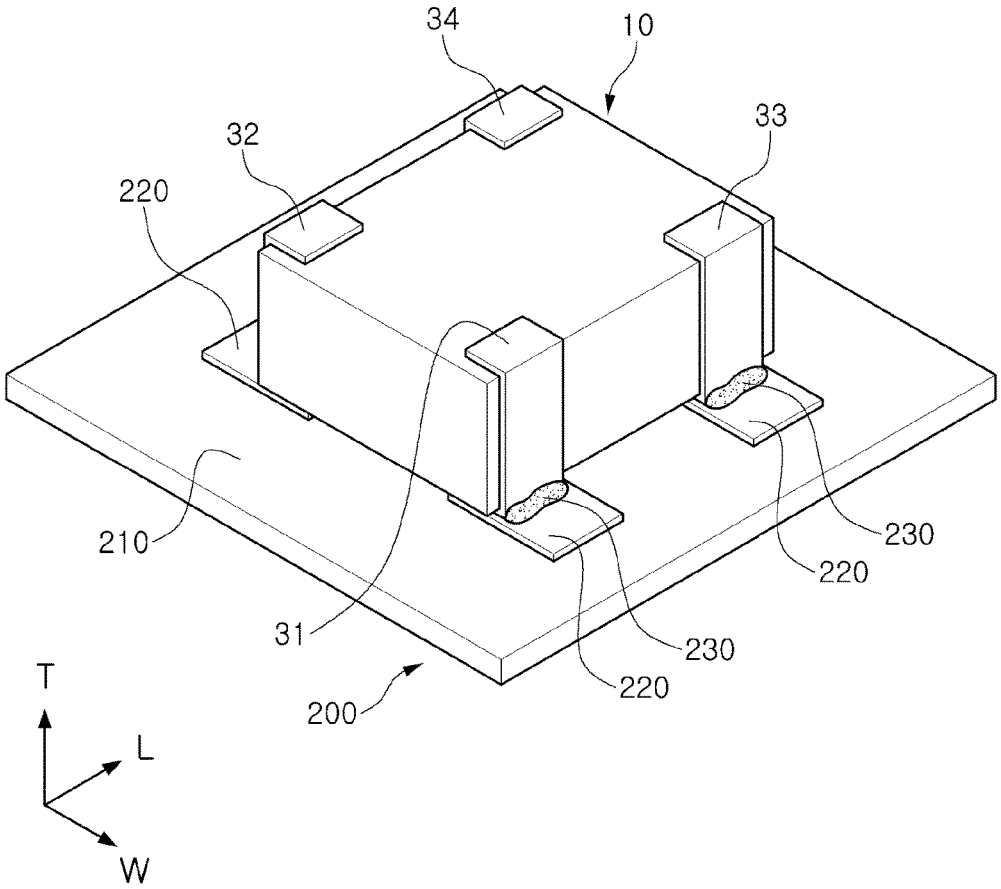
FIG. 5 is a perspective view of a board in which the coil component of FIG. 1 is mounted on a printed circuit board.

FIG. 5 is a perspective view of a board in which the coil component of FIG. 1 is mounted on a printed circuit board.

Referring to FIG. 5, aboard 200 having a coil component according to an exemplary embodiment may include the coil component and a printed circuit board 210 on which the coil component is horizontally mounted, and a plurality of electrode pads 220 may be formed to be spaced apart from each other on an upper surface of the printed circuit board 210.

In this case, the coil component may be electrically connected to the printed circuit board 210 by solders 230 in a state in which the first to fourth external electrodes 31 to 34 are positioned to contact the electrode pads 220, respectively.

Except for the description described above, a description of features overlapped with those of the coil component according to the previous exemplary embodiment will be omitted.

As set forth above, according to exemplary embodiments of the present disclosure, the coil component includes the connection part disposed to penetrate through two cores in the magnetic body while connecting the two cores to each other, such that coupling coefficient may be increased, and two coils disposed on the same plane are disposed in parallel to each other while being spaced apart from each other, such that leakage inductance may be increased.

Therefore, output current ripples and inductor current ripples may be simultaneously decreased, whereby efficiency of the inductor array chip may be improved without increasing a mounting area thereof.

While exemplary embodiments have been shown and described above, it will be apparent to those skilled in the art that modifications and variations could be made without departing from the scope of the invention as defined by the appended claims.

What is claimed is:

1. A coil component comprising:

a magnetic body including a substrate having two cores, first and second coil parts disposed on one surface of the substrate, and third and fourth coil parts disposed on the other surface of the substrate, wherein the two cores are defined as centers of the first and second coil parts, respectively;

a connection part disposed to penetrate through the two cores within the magnetic body and connecting the two cores to each other; and first to fourth external electrodes disposed on outer surfaces of the magnetic body and connected to the first to fourth coil parts, wherein the connection part is spaced apart from the first to fourth coil parts by a predetermined distance.

2. The coil component of claim 1, wherein the connection part contains at least one of Mn—Zn based ferrite, Ni—Zn based ferrite, Ni—Zn—Cu based ferrite, Mn—Mg based ferrite, Ba based ferrite, and Li based ferrite.

3. The coil component of claim 1, wherein the connection part has a polygonal or circular cross-sectional shape.

4. The coil component of claim 1, wherein the first and second coil parts are symmetrical to each other on the basis of a central portion of the magnetic body, and the third and fourth coil parts are symmetrical to each other on the basis of the central portion of the magnetic body.

5. The coil component of claim 1, wherein the first and third external electrodes are input terminals, and the second and fourth external electrodes are output terminals.

6. The coil component of claim 1, wherein the first and second coil parts have the same length.

7. The coil component of claim 1, wherein the first to fourth coil parts contain at least one selected from the group consisting of gold, silver, platinum, copper, nickel, palladium, and alloys thereof.

8. The coil component of claim 1, wherein the substrate is a magnetic substrate.

9. A board having a coil component, the board comprising:

a printed circuit board on which a plurality of electrode pads are provided; and the coil component mounted on the printed circuit board, wherein the coil component includes:

a magnetic body including a substrate having two cores, first and second coil parts disposed on one surface of the substrate, and third and fourth coil parts disposed on the other surface of the substrate, wherein the two cores are defined as centers of the first and second coil parts, respectively;

a connection part disposed to penetrate through the two cores in the magnetic body and connecting the two cores to each other; and first to fourth external electrodes disposed on outer surfaces of the magnetic body and connected to the first to fourth coil parts, wherein the connection part is spaced apart from the first to fourth coil parts by a predetermined distance.

10. The board of claim 9, wherein the connection part contains at least one of Mn—Zn based ferrite, Ni—Zn based ferrite, Ni—Zn—Cu based ferrite, Mn—Mg based ferrite, Ba based ferrite, and Li based ferrite.

11. The board of claim 9, wherein the connection part has a polygonal or circular cross-sectional shape.

12. The board of claim 9, wherein the first and second coil parts are symmetrical to each other on the basis of a central portion of the magnetic body, and the third and fourth coil parts are symmetrical to each other on the basis of the central portion of the magnetic body.

13. The board of claim 9, wherein the first and third external electrodes are input terminals, and the second and fourth external electrodes are output terminals.

14. The board of claim 9, wherein the first and second coil parts have the same length.

15. The board of claim 9, wherein the first to fourth coil parts contain at least one selected from the group consisting of gold, silver, platinum, copper, nickel, palladium, and alloys thereof.

16. The board of claim 9, wherein the substrate is a magnetic substrate.

* * * * *